United States Patent [19]

Menegus

[11] 3,968,765

[45] July 13, 1976

[54] ROTATABLE-MOUNTING APPARATUS FOR SAILS

[76] Inventor: Robert L. Menegus, 62 Major St., Clifton, N.J. 07013

[22] Filed: Oct. 10, 1974

[21] Appl. No.: 513,882

Related U.S. Application Data

[63] Continuation of Ser. No. 302,212, Oct. 30, 1972, abandoned, which is a continuation-in-part of Ser. No. 113,208, Feb. 8, 1971, abandoned.

[52] U.S. Cl. ..... 114/102; 114/39

[51] Int. Cl.[2] ..... B63H 9/04

[58] Field of Search ..... 114/39, 102, 103, 128, 114/129, 140–143, 149

[56] References Cited

UNITED STATES PATENTS

| | | | |
|---|---|---|---|
| 404,626 | 6/1889 | Hunt | 114/128 |
| 685,943 | 11/1901 | Pool | 114/128 X |
| 768,085 | 8/1904 | Stromberg | 114/149 |
| 2,858,788 | 11/1958 | Lyman | 114/39 |
| 2,893,339 | 7/1959 | Ram | 114/39 |
| 3,345,969 | 10/1967 | Purvis | 114/102 |
| 3,838,655 | 10/1974 | Kratz | 114/102 |

FOREIGN PATENTS OR APPLICATIONS

| | | | |
|---|---|---|---|
| 1,184,914 | 4/1966 | France | 114/102 |
| 1,423,958 | 11/1964 | France | 114/39 |

*Primary Examiner*—Trygve M. Blix
*Assistant Examiner*—Stuart M. Goldstein
*Attorney, Agent, or Firm*—Sommers & Sommers

[57] ABSTRACT

An apparatus for rotatably mounting a sail on racing yachts, sailboats and sailsleds, which includes a step adapted to be mounted on the hull of the craft, a boom, rigging connecting the sail to the boom, adapted to enable setting of the sail-to-boom orientation, and means for connecting the boom to the step so that the boom, sail and rigging are substantially freely rotatable about the step, and so that the orientation of the sail is maintained at a substantially constant angle with respect to the direction of the shifting apparent wind, to enable the sail to respond directly to shifting winds without requiring manual supervision, in order to provide maximum thrust with minimum drag for substantially increased racing yacht speed capabilities. A keel is connected to the bottom of the hull to rotate about a vertical axis through the abaft portion of the keel, in order to minimize racing yacht heeling and hydrodynamic drag. A rudder is rotatably connected astern, which includes a horizontal stabilizing fin oriented thereon so as to minimize racing yacht bucking by damping the yacht's response to choppy seas.

3 Claims, 5 Drawing Figures

B
ds
J
Pj
h
a
W
V
ms
t
f
g
R
n
m
x
a+f
4
E
k
S
Pm
M
b
f
m
3
z

60°
50°
f
40°
a
0
10°
20°

11'
11''
11
51
51'
50
50'
16'
15
34
10
17
13
FALCON
30
33
12
14
20
26

ROTATABLE-MOUNTING APPARATUS FOR SAILS

BACKGROUND OF THE INVENTION

This is a continuation of application Ser. No. 302,212, filed Oct. 30, 1972 and now abandoned, which was a continuation-in-part of application Ser. No. 113,208, filed Feb. 8, 1971 and now abandoned.

This invention relates generally to apparatus for sailboats and sailsleds, and more specifically relates to an apparatus for rotatably mounting sails on a racing yacht.

Racing yachts are designed to attain the highest speeds possible against the wind. A typical racing yacht includes a sleek hull, a mast mounted on the hull, a boom connected to the lower end of the mast extending generally parallel to the deck, sails connected to the hull, mast and boom by rigging, lines connecting the sails to the hull to enable manual regulation of the sail-to-hull orientation, and lines connecting the boom to the hull to enable manual regulation of the boom-to-hull orientation. The skill of the sailors in manipulating the lines connecting the sails to the hull and the lines connecting the boom to the hull in response to shifting wind forces, so as to obtain maximum thrust with minimum drag from shifting winds, largely determined whether the yacht would win the race. Efficiency in manipulating the lines connecting the boom to the hull and in trimming the sails by paying out and drawing in the lines connecting the sails to the hull generally depended upon the experience of the sailor in gauging the extent and duration of wind shifts, which factors were extremely difficult to accurately predict. Furthermore, speed attainable was dependent upon the design of the sail rig; inefficiently designed sail rigs generated excessive drag responsive to shifting wind forces. Performance further depended upon the design of the keel mounted on the bottom of the hull which provided lateral resistance to prevent the boat from being driven sideways excessively, and on the design of the hull; inefficiently designed keels subjected the racing yacht to unnecessary heeling and so generated substantial hydrodynamic drag, and inefficiently designed hulls subjected the racing yacht to bucking by amplifying the yacht's response to choppy seas.

SUMMARY OF THE INVENTION

In accordance with the foregoing, it is an object of this invention to provide an apparatus for rotatably mounting a sail on a racing yacht which responds directly to shifting wind forces without manual supervision to provide maximum thrust with minimum drag from such shifting wind forces. Another object of this invention is to provide a keel which is designed to minimize heeling and hydrodynamic drag, and a fin, which is designed to minimize bucking by damping the yacht's response to choppy seas.

The foregoing objects and others are achieved, in accordance with this invention, in an apparatus for rotatably mounting a sail on a racing yacht which includes a step adapted to be mounted on the hull of the racing yacht, a boom, rigging connecting the sail to the boom, and means for connecting the boom to the steps so that the boom, sail and rigging are substantially freely rotatable about the step relative to the hull, and so that the boom, sail and rigging respond so as to maintain a substantially constant angle with respect to the direction of the shifting apparent wind, to enable the sail to respond directly to shifting winds without requiring manual supervision, in order to provide maximum thrust with minimum drag for substantially increased racing yacht speed capabilities. A keel is provided which is connected to the hull to rotate about a vertical axis through the abaft portion of the keel, in order to minimize yacht heeling and hydrodynamic drag. A rudder is provided which is rotatably connected astern, which includes a horizontal stabilizing fin which is mounted on the rudder to extend generally perpendicular thereto so as to minimize racing yacht bucking by damping the yacht's response to choppy seas.

DESCRIPTION OF THE DRAWINGS

This invention is illustrated, by way of example, in the drawings, wherein.

DESCRIPTION OF THE PREFERRED EMBODIMENT

Figure 1:
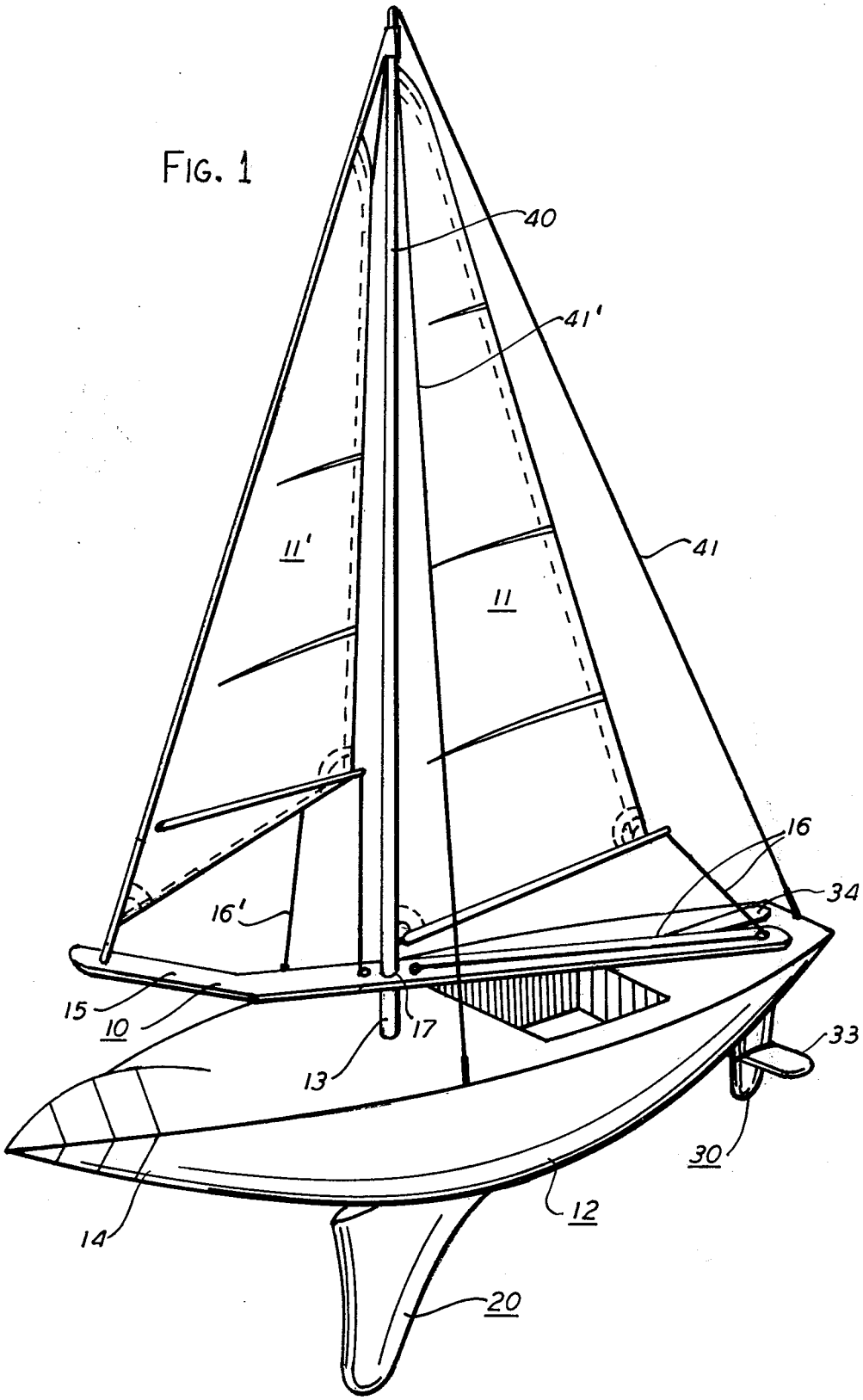
FIG. 1 is a perspective view of one embodiment of a racing sloop rigged yacht pursuant to the invention.
Figure 4:
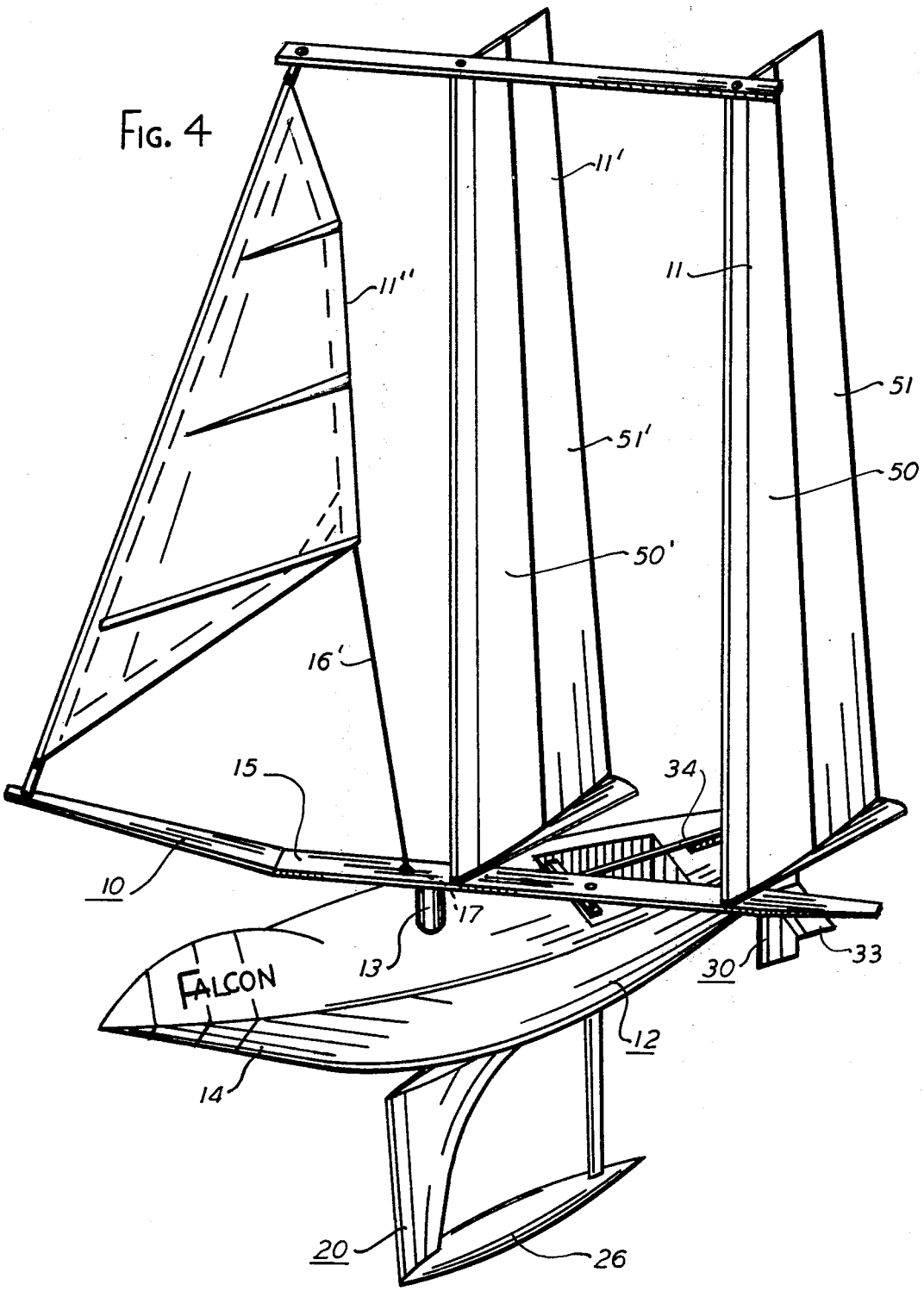
FIG. 4 is a perspective view of another embodiment of a racing schooner rigged yacht pursuant to the invention.
Figure 5:
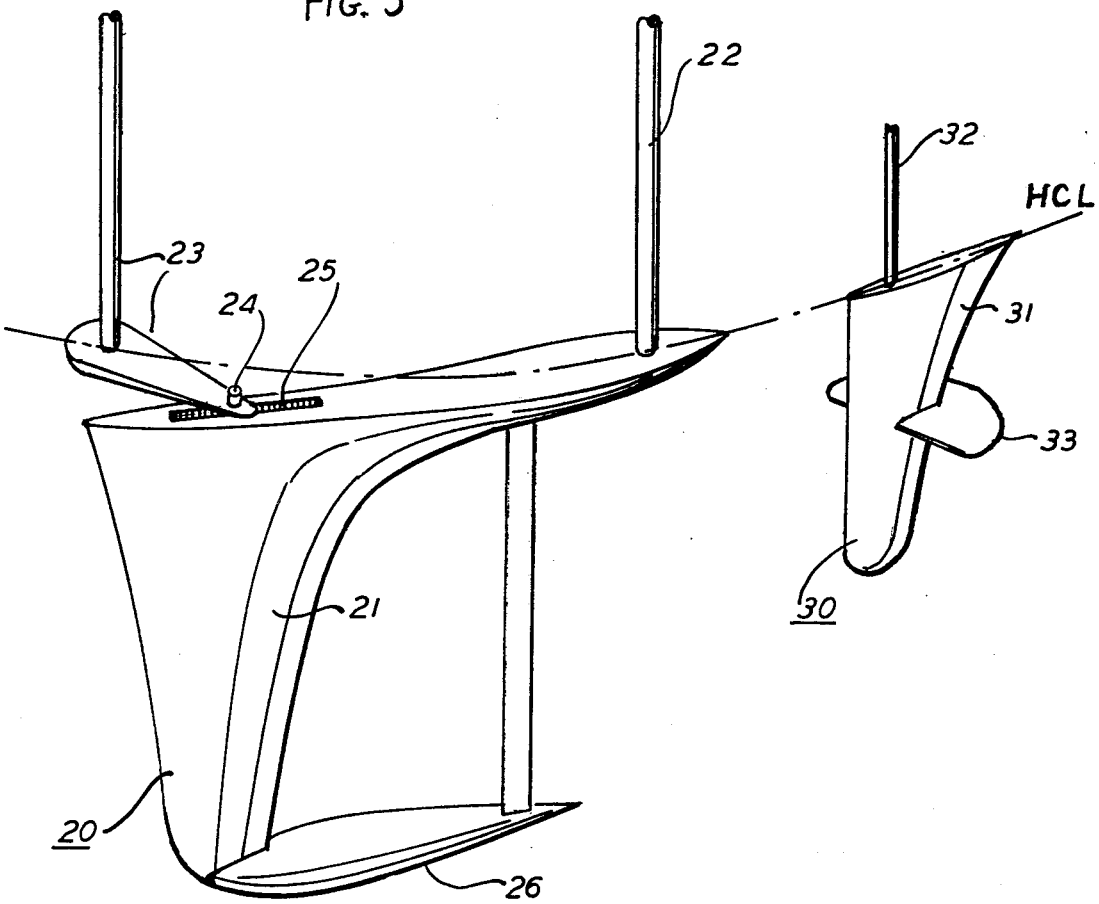
FIG. 5 is a perspective view of a keel and rudder pursuant to the invention.

In the preferred embodiment of the invention, the apparatus 10 for rotatably mounting a sail 11 on a racing yacht 12 comprises, for example, FIGS. 1, 4 and 5, a step 13 adapted to be mounted on the hull 14 of the racing yacht 12, a boom 15, rigging 16 connecting the sail 11 to the boom 15, and means 17 for connecting the boom 15 to the step 13 so that the boom 15, the sail 11, and the rigging 16 are freely rotatable about the step 13, and so that the orientation of the sail 11 is maintained at a substantially constant angle with respect to the direction of the shifting apparent wind. A keel 20, FIG. 5, comprises for example, a main fin 21 which is rotatably connected to the hull 14 by a shaft 22 which extends from the abaft portion thereof, and a bell crank 23 which is connected by a pin 24 to a slot 25 in the forward top portion of the main fin 21. Ballast 26 is mounted on the bottom portion of the main fin 21. A rudder 30, comprises, for example, a main fin 31 which is rotatably mounted astern by a shaft 32 which extends from the forward top portion thereof, a stabilizing fin which is mounted on a medial portion of main fin 31 extending generally perpendicular to the plane of the main fin 31, and a helm 34 which extends from the top portion of the shaft 32.

In one embodiment of the invention, FIG. 1, the step 13 comprises a portion of the mast 40, and mast stays 41, 41′ connect the mast 40 to the hull 14, the sail 11 comprises a mainsail, another sail 11′ is provided comprising a jibsail, and rigging 16′ connects the sail 11′ to the boom 15. In another embodiment of the invention, FIG. 4, the sail 11 and a further sail 11′ comprise the mainsail, and a further sail 11″ comprises a jibsail and the mainsail 11, 11′ is comprised of stiff planes 50, 50′ and flaps 51, 51′.

The boom 15, the sail 11, and the rigging 16 are substantially freely rotatable about step 13, and no lines are connecting the boom 15 to the hull for manual supervision of the boom-to-hull orientation, though the free angular rotation of boom 15 about step 13 is limited by stopping lines not shown. Normally the boom is not fixed with respect to the hull. Instead, dynamic wind pressure balances moments about the step to maintain a chosen and oblique attitude of the boom in relation to the apparent wind. As the apparent wind shifts, either atmospherically or by reason of the helmsman's maneuvers, the entire rig rotates with respect to the hull so as to preserve a desired angle of attack on the sails. Hence when the vessel or vehicle is steered to go about or jibe, the rig responds automatically. One may sil on any possible point, or in circles, by manning only the helm. Much of the sailing guess-work is eliminated. Close on the wind, rather than randomly luffing and stalling in the shifting wind as has been customary, the sails follow changes in wind direction; the apparatus is therefore inherently fast to windward.

Aeroperformance is improved in practice by setting the best obtainable sails 11, 11' at known, unvarying, optimum angles of attack with respect to the apparent wind, the apparent wind being different from the true wind because of the vessel's motion through both water and air. This desideratum is achieved by employing the freely rotating boom 15, on which all sails 11, 11' are mounted fore and aft of the step 13 and rigged, and which therefore preserves a steady attitude. Boom 15 carries and controls the positions of all the sails 11, 11', and it mounts all the rigging 16, 16', blocks, cleats, and gearing needed to set sails 11, 11' at required angles to the boom 15. The only connection between said boom 15 and the hull proper is through the step 13. Hence, mainsail 11 and jibsail 11' cannot exert turning moments on the yacht. The absence of any turning moment on the hull, so that but one resultant wind force is exerted, simplifies the beamwise thrust balance in the water, and it is easier to design the hull and keel system.

The racing yacht in FIG. 1 carries conventional mast stays 41 and 41'. But the installation of free boom 15 and its associated gear alters the entire sailing method, and the aeroperformance is improved according to the objects of the invention because the wind itself performs a function that no human could equal.

The racing yacht in FIG. 4 includes two relatively stiff planes with 50% flaps which constitute the mainsail 11, 11' and a well battened sheet forms the jibsail 11''. The structure near step 13 is made limber, so that the entire rig may deflect to take advantage of wind puffs and to drive very close to the wind. The boom's steady attitude is effected by designing the sail plan so as to position the resultant center of air effort considerably to lee of the rotating step 13, which step 13 is on the beamwise vertical plane passing through the center of gravity of the entire rig that rotates. Said resultant center of air effort may be changed with respect to the boom 15 promptly at will by varying the several sails' and planes' chordal angles to the longitudinal boom-centerline. In practice, one pays out or draws in sheets cleated to the boom to vary these angles, or one operates the gearings if it is used. For instance, when these sail-to-boom angles are increased by paying out lines, the after length of the boom 15 turns further off the weather side of the hull, and the angle of attack is decreased. So in a gale, reefing of sail is no longer necessary, provided the sails may be pulled flat and tight and not allowed to flutter. This particular low-attack sail trim is highly efficient in the situation when there is no sea room to go about and the breeze is light, for a great area of sails and planes and clearances is available for the wind to operate on. More moving air is presented to all the sails 11 than if the boom 15 is sheeted to leeward, as has been conventional for centuries, and less interference is encountered between individual sails 11.

Having set sails and planes with respect to the boom 15 according to a previously calculated plan that in part takes into account the race course in relation to the true wind, the helmsman is then better able to maximize the speed made good against the wind, or to make the best reach, as the occasion demands. For the apparent position of the free boom is infallible feedback, telling the helmsman when rudder adjustments are needed to cope with shifting winds. If the wind direction veers drastically, it may be desirable to go about on the other track, in which event the sail-to-boom angles are reversed without manual adjustments to the sail-sheets, if they are used. In any event, some computation is needed for racing. Calculations similar to these are well known to competing yachtsmen, and the virtue of maintaining a constant angle of attach between the airfoils and the apparent wind for any true wind is appreciated by the experienced helmsman, who heretofore has kept a sharp eye on the mainsail luff for signs of aerodynamic inefficiency. The sail mounting apparatus 10 properly trimmed, will not operate with a shaking cloth for more than a second or two no matter how tricky the wind.

When the helmsman would increase promptly the sails' angle of attach to the apparent wind, he does not put up the helm as had been established seamanship for centures, or put down the helm to decrease sail attack. Instead, his crew works on mainsail and jibsail lines 16 and 16'. This is to emphasize that operation at the helm 34 is completely independent of the prevailing sail trim. Once the diverse sails are tuned to their optimum angles of attach reckoned for a particular course and wind force, the helmsman is then free to steer with only the apparent wind the sea's chop in mind. Moreover, when clear of other craft to windward, it turns out that he need not be dextrous but even deliberate instead. On the close reach, for instance, this resolution of the helmsman's decision-making is of great advantage. Smart tacking is an obvious boon to the crew.

Yachtsmen commonly prefer to reeve rigging 16, 16' through a series of blocks so as to lead these lines downs to the deck near step 13, and from there aft to the vicinity of helm 34 or to conventional winches sometimes placed below deck (not shown). Still, the use of such or similar convenient sheet-handling does not impair the concept that rigging 16, 16' are in effect anchored to boom 15, for when said boom 15 rotates in an oscillatory manner to follow the fickle wind the sail-to-boom angles remain fixed.

Figures 2, 3:
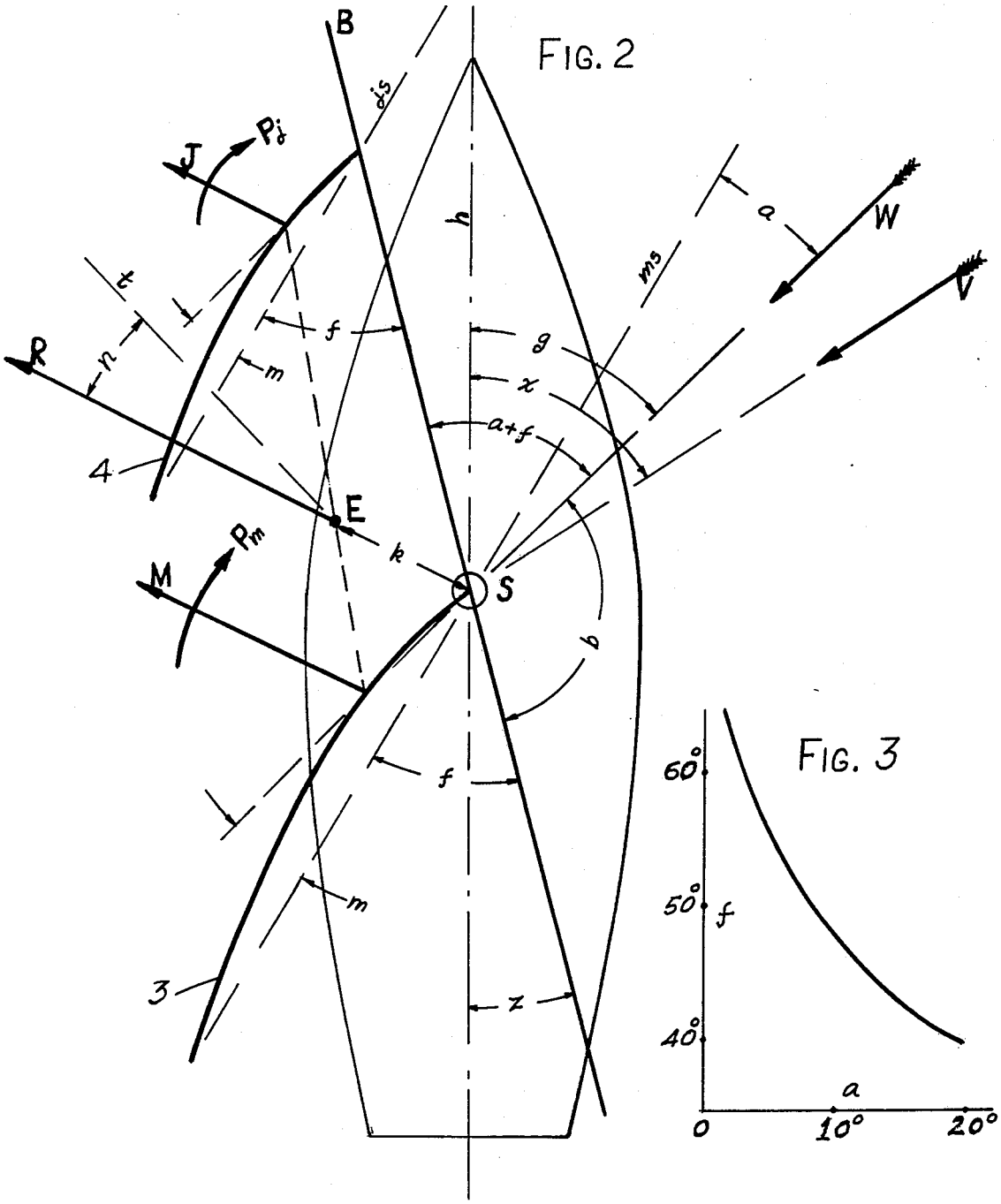
FIG. 2 is a diagram of the forces acting on the sails of the racing sloop rigged yacht.
FIG. 3 is a graph of the sail-to-boom angle for a desired sail angle of attack for the racing yacht.

The management of the sloop on the windward course may be studied in detail by perusing FIG. 2, a diagram of the forces and pitching moments applicable to the sail plan shown in FIG. 1. The true wind pressure vector is V pointing at the angle $x$ off the yacht's course $h$. Note that course $h$ is drawn as though the yacht makes zero leeway, or as if the main fin keel exerts all the required beamwise water thrust so that the hull drives straight along the water path. However, a degree or so of leeway is actually a better sailing parameter. Angle $x$ cannot be fixed in the helmsman's mind without computation. To him, angle $g$ off course $h$ appears to indicate the direction of the instantaneous apparent wind pressure vector W. He tries to steer the yacht at an average angle $g$ so that the water speed in the direction $h$, multiplied by the cosine of $x$, is the maximum possible with his available equipment. In other words, the objective is to formulate the present analysis to fetch the windward mark in the shortest time.

The apparent wind pressure vector W has the magnitude $$|W| = \frac{(\text{Air density})(\text{Wind speed of } W)^2}{2(\text{Gravitational constant})} \text{ pounds/ft}^2 \quad (1)$$

Wind pressure vector W exerts the force M measured in pounds on mainsail 11, and force J on jibsail 11'. Each of these sail forces is usually taken as the vector sum of a thrust perpendicular to W and a drag in direct line with W. And since we now focus on the sail rig alone, we account for only the sail thrusts and drags and pitching moments, properly ignoring the parasitic air drags impressed on the hull's freeboard and other gear. Thrusts, drags, and pitching moments for may airfoil sections are generally known in the form of dimensionless coefficients $C_t$, $C_d$, and $C_m$ respectively, all functions of camber and angle of attack. Also, the sails' induced drags are functions of their aspect ratios. The conventions used include for instance:

$$\text{Thrust} = |W|(\text{Planform area of foil})C_t \text{ pounds} \quad 2$$

R is the vector sum of M and J, and its magnitude is $$|R| = |W|(\text{Total sail area})C_t\text{Secant}(n) \text{ pounds} \quad 3$$

And R acts at the center of air effort E at a distance k from the freely rotating step S. Vector R points at the angle $n$ off line $t$, while line $t$ is perpendicular to W and passes through E. Angle $n$ is the important drag parameter of the airfoils, expressed as:

$$n = \text{Arctangent } \frac{\text{Sail drag, sum of parasitic and induced'}}{\text{Sail thrust}} \quad (4)$$

Considering a specific sail configuration, the drag angle $n$ varies only with angle of attack $a$, and angle $a$ is measured between W and the effective plane ms of mainsail 13. The effective plane js of the jibsail is generally parallel to plane ms.

The sail-to-boom angle f is measured between B the centerline of boom 15 and the effective planes of the sails, ms and js. But the center of effort of each airfoil is at the angle $(f+m)$ off B, the small angle m being the result of displacement of each center of effort off the sail's effective plane by reason of the sail's camber. Obviously, were the camber zero, $m$ would be zero.

By convention adopted in aerodynamics, no matter what the thickness of an airfoil may be, its center of effort is placed on the curved surface defined by the mid-thickness, and at a measured distance aft of the leading edge. For many sail sections the center of effort is located about 25% of the chord aft of the leading edge, and said location varies a bit with angle of attack. With increasing angle of attack, the center of effort usually moves aft, and not much. If both camber and angle of attack are not large, the center of effort is always at the quarter point of the true chord, and the true chord is the sail area divided by the span or length.

Then a balance of moments about the freely rotating step 13 yields after re-arrangement:

$$\text{Cosine}(a+f+m-n) + (C/4L\text{Cosine}(a-n) + (C/L)(c_m/c_t)\text{Cosine}(n) \quad 5$$

C is the average chord of all the sails (all averaging is done by weighting with sail area), and L is the average distance of the sails' luffs and axes of rotation (defining angle $m$) from S along B. The point defining L (not shown on FIG. 2, otherwise the drawing would be about doubly complex) is located forward of S on B if the rig is to be stable. L is always positive, and all three terms in Equation 5 are positive. Or, conversely, if the sails are set too far aft on boom 15, that is if L is too small, the rig turns out to be a fluttering wind vane with all drag and no thrust.

In the case of efficient planes, especially, the second term on the right of Equation 5 is of minor importance. In the limit, with zero camber, $C_m = 0$ at every a below stall.

By substituting Equation 4 in Equation 5, $f$ is computed as a function of $a$, resulting in FIG. 3 and providing the descriptive characteristic of a specific rig with fixed camber. The sail-to-boom angle to be set for any desired angle of attack has been determined.

Should a gale come up, for instance, rigging 16, 16' are payed out, thereby increasing $f$, and the sails are in other ways flattened. The resulting low angle of attack and low camber are then safe in the face of the high $|W|$.

Inspection of Equation 5, or experimentation in the wind tunnel, divulges that increasing the camber lowers either $f$ or $a$ or both. If the sail outhauls are slacked off without doing anything else, the angle of attack is decreased, and vice-versa. If normal operation is to be attained with an angle of attack less than about 5°, the sails should always be tight and flat (stiff battens and rugged clews). At low angles of attack, the pitching moments $P_m$ and $P_j$ are reduced as much as possible by sail-flattening so that the luffs won't go unstable with the slightest wind shift.

The yachtsman is concerned too about the dynamic response of the composite sail rig, or expressed in observable phenomena, about the manner in which changes in wind direction cause the rig to respond by rotating about step 13. Should the rig be light and limber, and thus of low polar moment of inertia about step 13, rotational stability is assured; this problem vanishes. Ordinarily, the quest for stability does no force a structural designer to take extreme measures in reducing spar weights, but it is nonetheless wise to increase stability by making the righting arm $k$ as large as is convenient.

Earlier it was mentioned that the apparent position of boom 15 with respect to the hull indicates what course changes are needed to cope with a shifting breeze. With the sails tuned to the optimum, the helmsman observes the deviations in angle $z$, FIG. 2, and steers so as to limit these deviations according to the helmsman's experience. Expert yachtsmen have spent years learning how to follow the shifting wind, and to judge which shifts to ignore.

An efficient sail configuration is half the objective; the other half is a low-drag hull. For engineering convenience, the total water drag on the hull and keel system is divided into; skin, profile, wave, and induced drags. All these components have been studied extensively to minimize their sum, it is truly known that a yacht heeled hard to leeward suffers considerably more drag than one sailing upright, and the heel can be reduced by shifting ballast to windward. A novel way to accomplish the shift is to rotate the main fin 21, here made heavy, about its aftermost hull-mount, thereby moving the yacht's center of gravity toward the weather side.

Also, since the shift in weight is accompanied by rotation, the main keel assumes a desired angle of attack with respect to the water streaming past the hull, and the leeway made by the hull proper could then be reduced to nearly zero. Because the fin keel is more efficient than the hull proper in providing the required thwartwise thrust, keel rotation has the effect of lowering the induced water drag.

FIG. 5 shows one preferred arrangement of the keel and rudder, which along with the hull form the keel system. Only the centerline of the hull, along its bottom, is shown as a line HCL. The aftermost hull mount 22 permits the keel 20 and ballast body 26 to be displaced to weather by turning bell crank 23 at the same time rotating the fin keel. Said bell crank has a substantially vertical pin 24 at its radial extremity that fits into and slides in slot 25, thereby providing support and orientation for the main fin 21 and ballast body 26.

The keel system includes the main fin keel, the hull proper, and the rudder. Each lateral surface contributes some water thrust perpendicular to the yacht's course, especially when operating with the sometimes preferred light weather helm. Nevertheless, by far the greatest thrust should be exerted by the main fin keel, the most efficient of the three keel elements.

Main fin 21 is rotatable about its aftermost hull-mount, being then displaced beamwise to weather, thereby increasing its water angle of attack and decreasing the yacht's heel and drag. On sailing close to the wind, the yacht's heeling force is greatest, and the required angle of attack is also greatest. Therefore, this sailing condition is assumed for the purpose of designing the optimum keel, and its mounts, a keel system that suffers the least water drag for the thrust needed.

A hull designed for minimum drag may have a tendency to buck that is to amplify the high frequency angular oscillation induced by choppy water. This bucking is sometimes damped by providing on the hull a long overhang at the stern, an otherwise parasitic structure since it contributes nothing to the steady-state buoyancy or thrust and it adds detrimental air drag and weight. A better way is to mount horizontal, submerged, stabilizing fin either on the rudder or on its own vertical fin located far aft. This small stabilizing fin is designed to dissipate vertical components of energy and so damps the bucking with less parasitic effect.

Rudder 30 is conventionally located far aft, and could therefore serve as a mount for stabilizing fin 33, which is always submerged. Fin 33 damps the bucking, and its optimum size depends to a degree on the frequency and amplitude of the waves likely to be encountered. Hence, two or three assemblies of rudder-and-fin readily interchangeable according to the weather would be desirable.

While the present invention has been set forth in terms of specific embodiments thereof, it will be understood, in view of the instant disclosure, that variations may be made by those skilled in the art within the scope of the invention and disclosure. The invention is therefor to be broadly construed within the scope and spirit of the claims.

I claim:

1. An apparatus for mounting sails on a racing yacht, which comprises:

a. a step, adapted to be mounted on the hull of the racing yacht;

b. an elongated unitary boom;

c. rigging, connecting the sails to the boom; and d. means for connecting the boom, intermediate its ends, parallel to and spaced from the hull, with no means other than the step connecting the boom to the hull, whereby the boom, sails and rigging are substantially freely rotatable as a unit about the step and relative to and unconnected to the hull, and so that the boom, sails and rigging will automatically respond to maintain a substantially constant angle with respect to the direction of the shifting apparent wind, to provide maximum thrust, with minimum drag, for substantially increased yacht speed capabilities;

e. a rudder movably connected to the hull;

f. and a helm connected to the rudder for movement thereof angularly relative to the longitudinal axis of the boom.

2. A sail rotatable-mounting apparatus as recited in claim 1, further comprising a keel, and means for connecting the keel to the hull of the racing yacht so that the keel is rotatable about a verticle axis which extends through the abaft portion thereof.

3. An apparatus for mounting sails as recited in claim 1, further comprising:

a. a keel, b. means connecting the keel to the hull of the yacht for rotation of the keel about a vertical axis which extends through the abaft portion thereof;

c. said keel having a slot therein; and d. means secured to the hull, and depending therefrom into said keel slot, movably connecting the keel to hull.

* * * * *

UNITED STATES PATENT OFFICE

CERTIFICATE OF CORRECTION

Patent No. 3,968,765 Dated July 13, 1976

Inventor(s) Robert L. Menegus

It is certified that error appears in the above-identified patent and that said Letters Patent are hereby corrected as shown below:

Column 1, line 63, "steps" should read -- step --.

Column 4, line 22, "attach" should read -- attack --.
line 31, "attach" should read -- attack --.
line 38, "attach" should read -- attack --.
line 48, "down" should read -- downs --.

Column 5, line 21, "may" should read -- many --.

Figure 1: Reference numeral 16' should indicate the jib sheet rather than the starboard shroud, as on Figure 4.

Signed and Sealed this

Twelfth Day of April 1977

[SEAL]

*Attest:*

RUTH C. MASON
*Attesting Officer*

C. MARSHALL DANN
*Commissioner of Patents and Trademarks*